US008327924B2

(12) United States Patent
Muley et al.

(10) Patent No.: US 8,327,924 B2
(45) Date of Patent: Dec. 11, 2012

(54) HEAT EXCHANGER FIN CONTAINING NOTCHES

(75) Inventors: Arun Muley, Ranchos Palos Verdes, CA (US); Joe Borghese, Yucca Valley, CA (US); Michael Williams, Harbor City, CA (US)

(73) Assignee: Honeywell International Inc., Morristown, NJ (US)

( * ) Notice: Subject to any disclaimer, the term of this patent is extended or adjusted under 35 U.S.C. 154(b) by 1195 days.

(21) Appl. No.: 12/167,992

(22) Filed: Jul. 3, 2008

(65) Prior Publication Data

US 2010/0000722 A1 Jan. 7, 2010

(51) Int. Cl.
*F28F 13/00* (2006.01)

(52) U.S. Cl. ..... 165/135; 165/166

(58) Field of Classification Search ..... 165/135, 165/152, 166

See application file for complete search history.

(56) References Cited

U.S. PATENT DOCUMENTS

| | | | | |
|---|---|---|---|---|
| 2,571,631 | A * | 10/1951 | Trumpler | 165/166 |
| 2,656,158 | A * | 10/1953 | Hodson et al. | 165/166 |
| 4,681,155 | A * | 7/1987 | Kredo | 165/76 |
| 5,033,540 | A * | 7/1991 | Tategami et al. | 165/135 |
| 5,078,207 | A * | 1/1992 | Asano et al. | 165/153 |
| 7,104,312 | B2 | 9/2006 | Goodson | |
| 7,290,595 | B2 * | 11/2007 | Morishita et al. | 165/109.1 |
| 7,360,309 | B2 | 4/2008 | Vaidyanathan | |
| 2002/0002853 | A1 * | 1/2002 | Gerard | 72/335 |
| 2003/0106677 | A1 * | 6/2003 | Memory et al. | 165/135 |
| 2005/0183851 | A1 | 8/2005 | Kelly | |
| 2006/0102332 | A1 | 5/2006 | Taras | |
| 2007/0056721 | A1 * | 3/2007 | Usui et al. | 165/183 |
| 2007/0169922 | A1 | 7/2007 | Pautler | |
| 2008/0093051 | A1 | 4/2008 | Rios | |
| 2008/0105420 | A1 | 5/2008 | Taras | |

FOREIGN PATENT DOCUMENTS

| | | | |
|---|---|---|---|
| JP | 62225896 | A * | 10/1987 |
| JP | 2008014566 | A * | 1/2008 |

* cited by examiner

*Primary Examiner* — Allen Flanigan
(74) *Attorney, Agent, or Firm* — Shimokaji & Assoc., PC

(57) ABSTRACT

A heat exchanger fin capable of increasing convective heat transfer by reducing internal conduction along an undesirable direction within the heat exchanger fin itself is disclosed. More specifically, the current invention reduces conduction within the heat exchanger fin along an undesirable direction along the direction of fluid flow because such conduction decreases the performance of the heat exchanger fin. A heat exchanger fin in accordance with the present invention utilizes a plurality of notches within the heat exchanger fin that is perpendicular to the direction of fluid flow to increase the resistance of conduction within the heat exchanger fin itself. By increasing the resistance of conduction in an undesired direction, the heat exchanger fin is capable of more uniform temperature to along the entire surface area to facilitate increase convective heat transfer in the desired direction.

4 Claims, 4 Drawing Sheets

HEAT EXCHANGER FIN CONTAINING NOTCHES

GOVERNMENT RIGHTS

This invention was made with Government support under FA8650-07-2-2720 awarded by USAF/AFMC Airforce Research Laboratory, Wright-Patterson AFB, Ohio. The government has certain rights in this invention.

BACKGROUND OF THE INVENTION

The current invention relates to an improved heat exchanger fin, and more particularly, an improved heat exchanger fin that can be used to control an undesirable temperature gradient caused by the natural conductive tendencies of the fins of a heat exchanger. Minimizing undesirable temperature gradient along an undesirable direction within the heat exchanger fins increases a convective heat transfer along the desired direction, thus increasing the performance of the heat exchanger.

As electromechanical components inevitably get more and more complicated, there is an increased need to minimize the size of heat exchangers of such electromechanical components while at the same time increasing the heat exchange rate. Because so much of the efficiency of the heat exchanger is dependent upon the heat exchanger fins themselves, it is desirable to try and maximize the efficiency heat exchanger fins within a heat exchanger.

Newton's law of cooling sets up the basis of thermal heat energy transfer Q as a function of the heat transfer coefficient h, surface area for heat transfer A, and the temperature difference of the two surfaces ($T_o - T_{env}$). The formula below sets up the relationship of the above mentioned variable.

$$\frac{dQ}{dt} = h * A(T_O - T_{env}) \tag{1}$$

Based on the above equation (1), it can be seen that one of the ways to increase the thermal heat energy transfer Q is to increase the heat transfer coefficient h. In order to increase the heat transfer coefficient h, materials having high conductivity such as silicon and copper can be used to make the fins of the heat exchanger which results in an increased thermal heat transfer rate Q. However, increase in conductivity of a heat exchanger fin material can only be limited to conductivity of the materials themselves, thus limiting the developments in this respect.

Alternatively, another way to increase heat transfer Q is to increase contact surface area A. By increasing the contact area A between a hot fluid and a cold fluid, there is more surface area A to transfer heat between the two fluids. However, increasing the contact surface area A of the heat exchanger also tends to increase the overall size of the heat exchanger itself, making it undesirable in situations where an increase in size is undesirable.

In order to address the need to increase contact surface areas A while minimizing the size of the heat exchangers, improvements in creating fin geometries that dramatically increase the contact surface area A without any major sacrifice to the overall size of the heat exchanger have led to the developments of microchannel heat exchanger fins. In accordance with the microchannel concept, circular and rectangular microchannel heat exchangers have also been employed in compact heat exchangers due to superior performance based on their geometric composition.

Although microchannel heat exchangers have been the answer to maximizing contact surface area A, they may conduct heat within the microchannel heat exchanger fins themselves. The conduction of heat within the microchannel heat exchanger fin creates an undesirable temperature gradient within the microchannel heat exchanger fin itself. This conductive effect called "matrix conduction" generally occurs when the heat exchanger is faced with extreme levels of heat and the proximity of the microchannels within the microchannel heat exchanger fin allows conduction of thermal energy. Matrix conduction generally results in heat conduction occurring in an undesired direction, causing the convective heat transfer performance along the desired direction to suffer. Ultimately, matrix conduction within a fin of a microchannel heat exchanger is undesirable, as it decreases the performance of heat transfer from the hot fluid to the cold fluid along the desired direction of flow.

Hence, it can be seen that there is a need for an innovative microchannel heat exchanger that increases the heat transfer coefficient h, while at the same time addressing the adverse matrix conduction problem occurring within the individual fins themselves, all while maintaining the lightweight, compact design of a heat exchanger without sacrificing convective heat transfer.

SUMMARY OF THE INVENTION

In one aspect of the present invention a heat exchanger fin comprises a fluid inlet positioned at a first terminal end of the heat exchanger fin, a fluid outlet positioned at a second terminal end of the heat exchanger fin opposite to the first terminal end, and a plurality of notches positioned perpendicular to a direction of fluid flow from the fluid inlet to the fluid outlet; wherein the plurality of notches reduces a heat transfer along the direction of fluid flow.

In another aspect of the invention, a method of reducing a conductive heat transfer in an undesirable direction within a heat exchanger fin, the method comprises of determining a direction of fluid flow through the heat exchanger fin, and increasing an internal conductive resistance of the heat exchanger fin along the direction of fluid flow; wherein the increase in the internal conductive resistance is achieved by placing a plurality of notches perpendicular to the direction of flow.

In a further aspect of the invention, a cross flow heat exchanger increasing heat transfer performance comprises of a plurality of hot plate fins within the cross flow heat exchanger; wherein the plurality of hot plate fins further comprises of a hot fluid inlet positioned at a first terminal end of the plurality hot plate fins, a hot fluid outlet positioned at a second terminal end of the plurality of hot plate fins opposite to the first terminal end; and a plurality of hot notches perpendicular to a direction of hot fluid flow from the hot fluid inlet to the hot fluid outlet; wherein the plurality of hot notches reduce a heat transfer along the direction of hot fluid flow; a plurality of cold plate fins vertically interposed between the plurality of hot plate fins, wherein the plurality of cold plate fins further comprises of a cold fluid inlet positioned at a first terminal end of the plurality of cold plate fins, a cold fluid outlet positioned at a second terminal end of the plurality of cold plate fins opposite to the first terminal end, and a plurality of cold notches perpendicular to a direction of cold fluid flow from the cold fluid inlet to the cold fluid outlet; wherein the plurality of cold notches reduce a heat transfer along the direction of cold fluid flow; and wherein the direction of cold fluid flow is perpendicular to the direction of hot fluid flow.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

The present invention provides an improved heat exchanger fin that reduces matrix conduction in an undesirable direction along the direction of fluid flow. Although the current invention lends itself especially well in a microchannel fin context, the current invention may be applicable in numerous other heat exchanger fins such as a plain rectangular fin, an offset rectangular fin, a wavy rectangular fin, or even a louvered triangular fin context without departing from the scope of the present invention. Moreover, although the particular invention in the current context may be shown in a simple cross-flow fin heat exchanger context, the current invention could be applicable in a counter-flow heat exchanger context, a parallel flow heat exchanger context, a folded flow heat exchanger context, a cross-counter flow heat exchanger context, or any other heat exchanger that could benefit from the reduction of matrix conduction without departing from the scope of the present invention.

The current invention generally provides a heat exchanger fin with a dramatic improvement of performance by addressing the matrix conduction issue associated with high performance heat exchanger fin such as the microchannel heat exchanger fin. The current invention utilizes a plurality of notches within the heat exchanger fin placed perpendicular to the direction of the undesirable matrix conduction to create a more strenuous path for the thermal energy to travel along the undesirable direction of the matrix conduction. This is unlike the prior art heat exchanger fins wherein the fin is solid along the entire path of the undesirable direction of heat transfer, making it susceptible to matrix conduction, hence reducing the performance of the heat exchanger fin.

Figure 1:
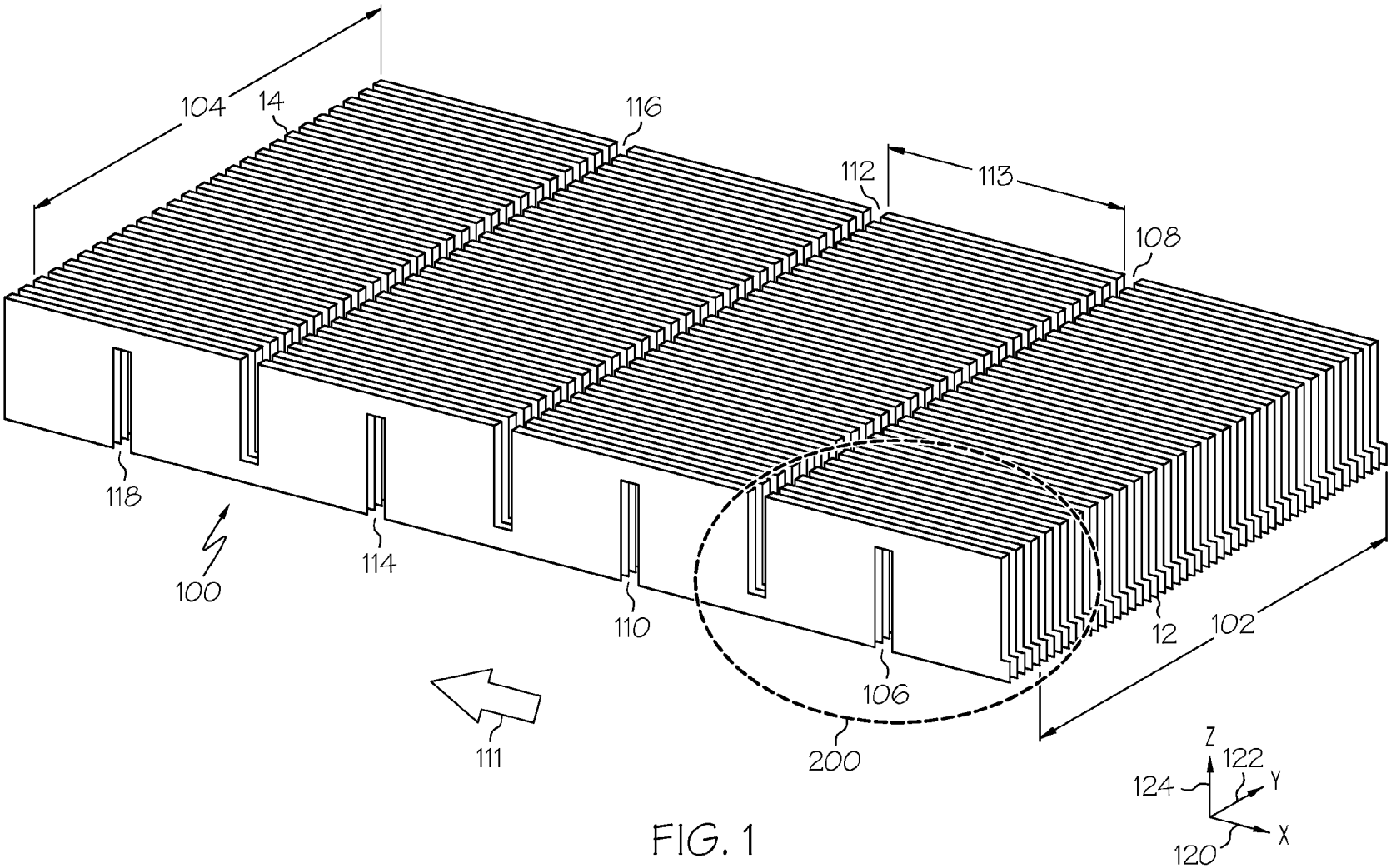
FIG. 1 is a prospective view of the current invention, showing a heat exchanger fin.

FIG. 1 shows a heat exchanger fin 100 in accordance with an exemplary embodiment of the current invention. It should be understood that the current invention, although shown in an exemplary context of a microchannel heat exchanger fins, could also be applicable other heat exchanger fins that also suffer from matrix conduction problem without departing from the scope of the present invention.

First and foremost, it is worth noting the axis of reference within FIG. 1, defined as an X-direction 120, a Y-direction 122, and Z-direction 124. These references are important in defining the direction of flow with heat exchanger fin 100.

The heat exchanger fin 100 as shown in FIG. 1 may contain a fluid inlet 102 at a first terminal end 12 of the heat exchanger fin 100, a fluid outlet 104 at a second terminal end 14 of the heat exchanger fin 100, and a fluid flow direction 111 starting at fluid inlet 102 and ending at fluid outlet 104 along the X-direction 120. A plurality of notches 106, 108, 110, 112, 114, 116, and 118, may be placed perpendicular to the direction of fluid flow 111 to interrupt the matrix conduction of thermal energy from fluid inlet 102 to fluid outlet 104 by creating a strenuous path for the thermal energy to travel along the undesirable X-direction 120. Although plurality of notches 106, 108, 110, 112, 114, 116, and 118, as shown in this current exemplary embodiment may be placed perpendicular to the direction of fluid flow 111, plurality of notches 106, 108, 110, 112, 114, 116, and 118, may also be at a 10°, 20°, 30° 40°, or even 45°, without departing from the scope of the present invention so long as it serves to reduce the undesirable effect of matrix conduction.

The placement of the plurality of notches 106, 108, 110, 112, 114, 116, and 118 within heat exchanger fin 100 may alternate between the top surface of heat exchanger 100 and the bottom surface of heat exchanger 100 in order to increase the resistance of the path of conductivity within heat exchanger fin 100, which in turn decreases matrix conduction along the undesirable X-direction 120. However, it should be noted that plurality of notches 106, 108, 110, 112, 114, 116, and 118 may be placed entirely on the top surface of heat exchanger fin 100, entirely on the bottom surface of heat exchanger fin 100, or any other combination of placement that may be capable of increasing the resistance of the path of conductivity without departing from the scope of the present invention.

The notch pitch 113 may be the distance between any one of the plurality of notches 106, 108, 110, 112, 114, 116, and 118, and a notch adjacent to that notch the plurality of notches 106, 108, 110, 112, 114, 116, and 118 For example, the distance between notch 106, and notch 108 may be described a notch pitch 113. As a further example, the distance between notch 108 and notch 110 may also be described as notch pitch 113. Notch pitch 113 can be varied to change the effectiveness of the reduction of thermal conductivity. In this current exemplary embodiment, the notch pitch 113, may be set at 0.25 inches to maximize performance of heat exchanger fin 100, however other notch pitch such as 0.10 inches, 0.50 inches, 0.75 inches, 1 inch, or any other notch pitch distance feasible within heat exchanger fin 100 may also be used without departing from the scope of the present invention.

Plurality of notches 106, 108, 110, 112, 114, 116, and 118 may be rectangular in shape as shown in FIG. 1 to maximize the resistance path of conductivity along the undesirable direction with the direction of fluid flow; however, plurality of notches 106, 108, 110, 112, 114, 116, and 118 may also be triangular, square, round, or any other shape capable of increasing resistance of conductivity of the heat exchanger fin 100 along the undesirable direction without departing from the scope of the present invention.

Figure 2:
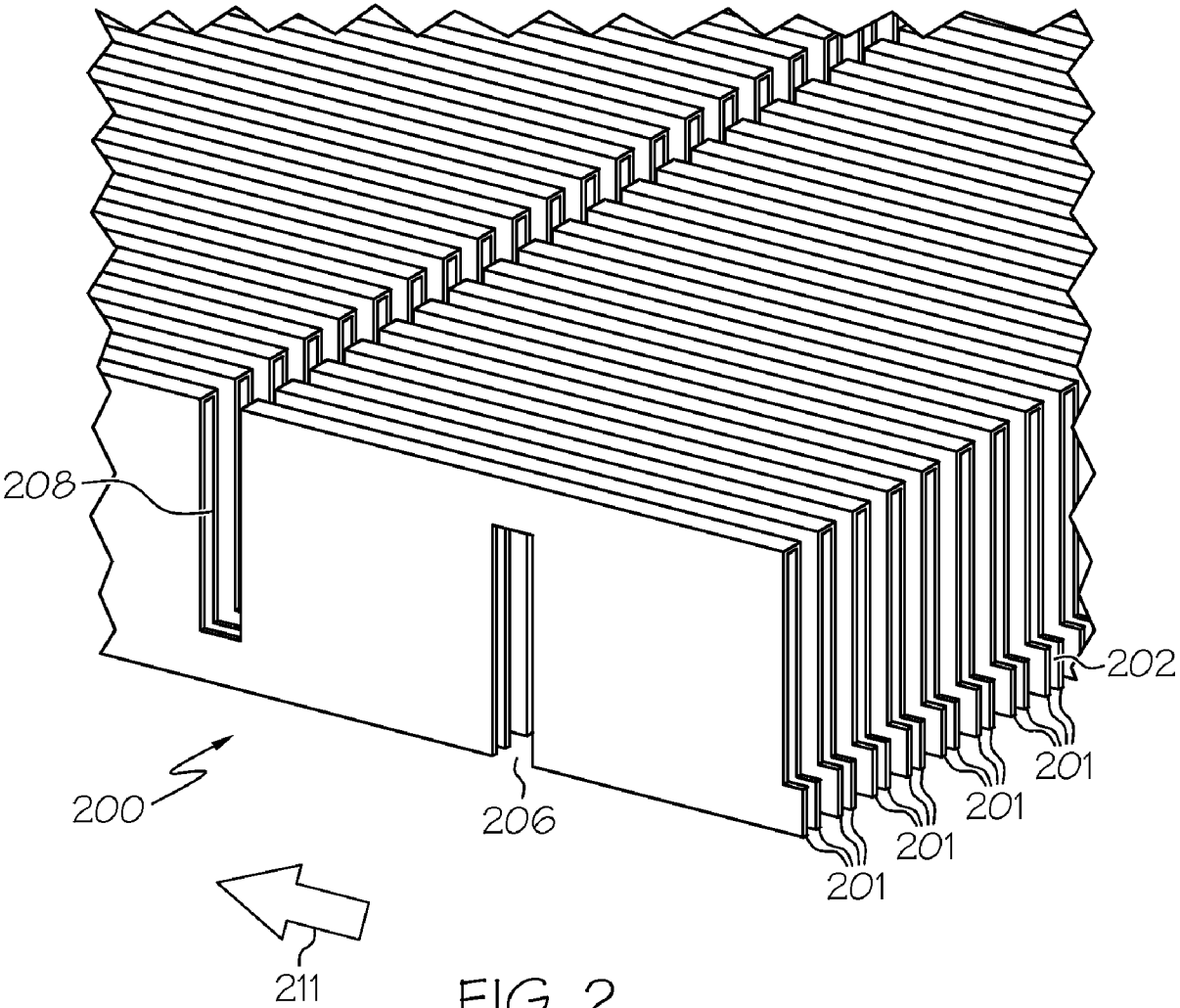
FIG. 2 is an enlarged prospective view of the current invention, showing the microchannels within the heat exchanger fin.

FIG. 2 shows an enlarged prospective view of an exemplary embodiment of the current invention as shown by heat exchanger fin 200. The enlarged view of an exemplary embodiment of the current invention may allow the details of the microchannels 201 to be shown in a detailed context. Moreover, the enlarged view of an exemplary embodiment of the current invention may show plurality of notches 206 and 208, and their relationship with respect to the microchannels 201. It should be noted that in FIG. 2, the microchannels 201 in heat exchanger fin 200 may be placed in a way such that the slots run parallel to the direction of fluid flow 211 from fluid inlet 202 towards the outlet at the opposite end of heat exchanger fin 200 to increase the contact surface area to facilitate heat transfer between the fluids.

Figure 3:
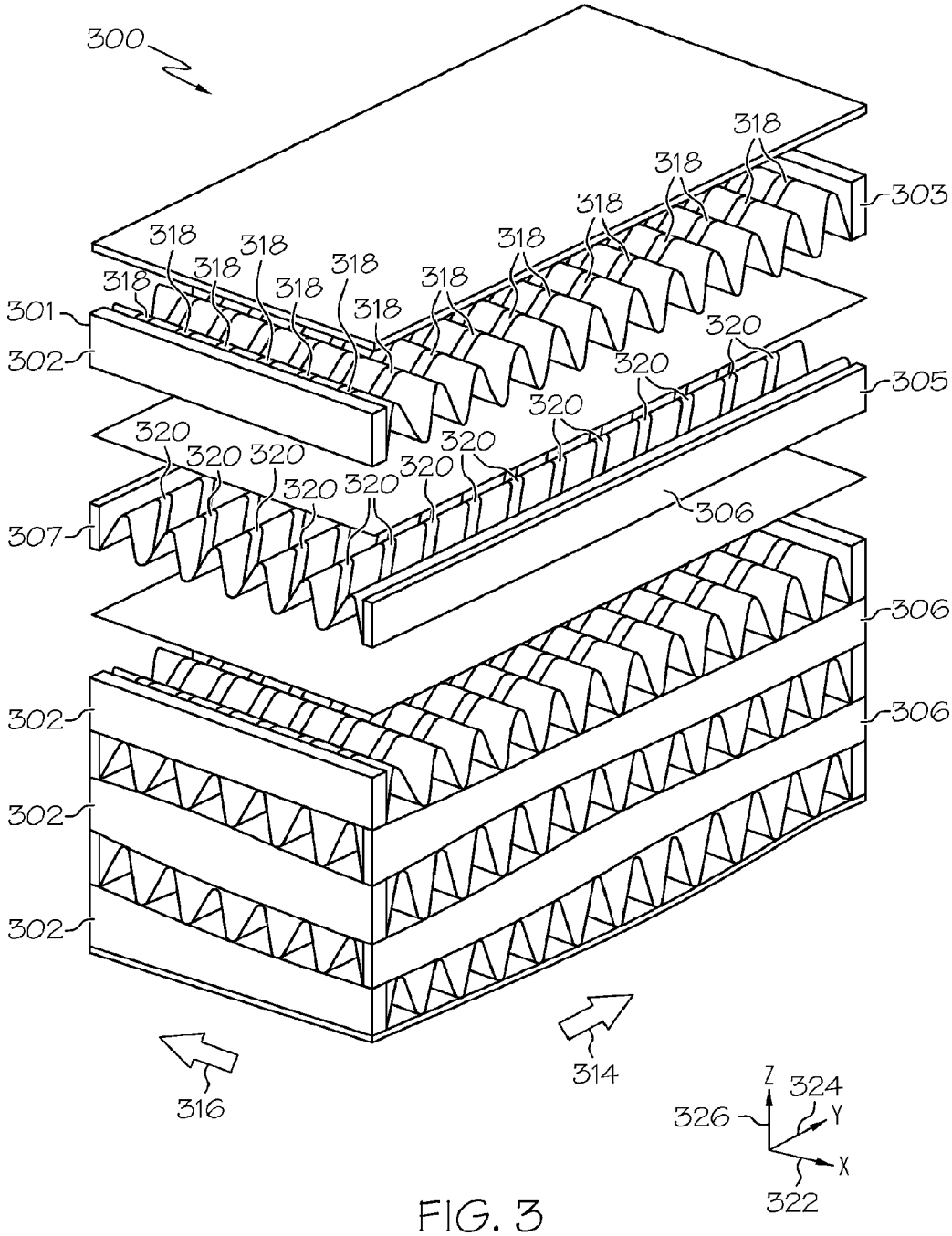
FIG. 3 is a prospective view of a heat exchanger incorporating the current invention of a heat exchanger fin.

FIG. 3 shows the current heat exchanger fins being implemented within a heat exchanger system 300 in accordance with an exemplary embodiment of the current invention.

First and foremost, it is worth noting the axis of reference within FIG. 3, defined as an X-direction 322, a Y-direction 324, and Z-direction 326. These references are important in defining the direction of flow with heat exchanger system 300.

Heat exchanger system 300 in this current exemplary embodiment may be shown as a cross flow heat exchanger system in FIG. 3, however, as indicated above, heat exchanger system 300 may also be a counter-flow heat exchanger context, a parallel flow heat exchanger context, a folded flow heat exchanger context, a cross-counter flow heat exchanger context, or any other heat exchanger that could benefit from the reduction of matrix conduction without departing from the scope of the present invention.

Being a cross flow heat exchanger, heat exchanger system 300 may contain a direction of cold fluid flow 316 along an X-direction 322 and a direction of hot fluid flow 314 along a Y-direction 324. Heat exchanger system 300 may also contain cold plate fins 302 that have hot fluid flowing from an inlet 301 of the cold plate fins 302 towards the outlet 303 of the cold plate fins 302, with the inlet and the outlet defined by direction of hot fluid flow 314. Heat exchanger system 300 may also contain hot plate fins 306 that have cold fluid flowing from an inlet 305 of the hot plate fins 306 towards the outlet 307 of the hot plate fins 306, with the inlet and outlet defined by direction of cold fluid flow 316. The hot plate fins 306 and the cold plate fins 302 may be alternating with each other along the Z-direction 326 on to allow the heat transfer to occur along the Z-direction 326 between hot plate fins 306 to cold plate fins 302.

The cross flow arrangement of the hot plate fins 306 and cold plate fins 302 indicates the desired direction of heat transfer to be generally along the Z-direction 326 between the hot plate fins 306 and the cold plate fins 302, while the undesired direction of heat transfer to be generally along the X-directions 322 and Y-directions 324. The heat transfer along the undesired direction may generally be caused by matrix conduction, which eliminates the effectiveness of heat transfer along the Z-direction 326 at the outlet end 307 of the hot plate fins 306 and cold plate fins 302, as the temperature has been dissipated. As it can be seen from the cross flow arrangement of heat exchanger system 300 in FIG. 3, matrix conduction may reduce the amount of thermal energy at the outlet portion of the heat exchanger fins that can be transferred along the Z-direction 326.

It is worth nothing that FIG. 3 may show an enlarged corrugation of the hot plate fins 306 and cold plate fins 302 to symbolizing the direction and arrangement of the microchannels 201 shown in FIG. 2 within a heat exchanger 300 context. Microchannel 201 may generally be more tightly corrugated than as it is shown in FIG. 3, and the loose corrugation shown in FIG. 3 is for illustrative purposes, not intended to limit the scope of the present invention.

Finally, plurality of hot notches 320 on hot plate fins 306 may be perpendicular to the direction of hot fluid flow 316 to create resistance of the heat transfer along the X-direction 322, hence may reduce matrix conduction within the individual hot plate fins 306 along the X-direction 322. Similarly, plurality of cold notches 318 on cold plate fins 302 may be perpendicular to the direction of cold fluid flow 314 to create resistance of the heat transfer along the Y-direction 324.

Figure 4:
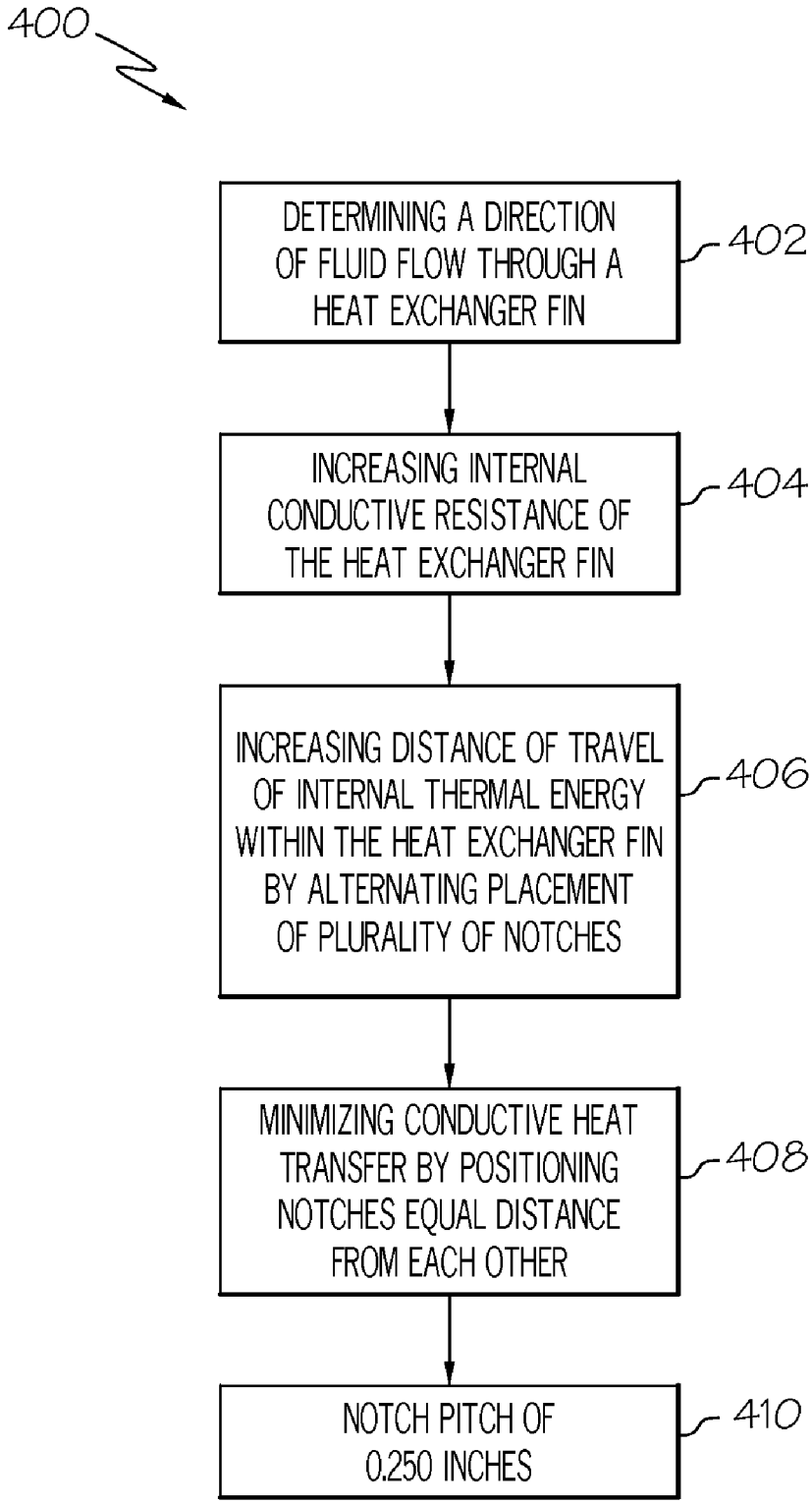
FIG. 4 shows a method of reducing heat transfer in an undesirable direction within a heat exchanger fin in accordance with the present invention.

FIG. 4 shows a method 400 of reducing conductive heat transfer in an undesirable direction within a heat exchanger fin in accordance with the current invention. Starting at step 402, a direction of fluid flow through a heat exchanger fin from an inlet of the heat exchanger fin to an outlet of the heat exchanger fin may be determined. Subsequent to the determination of the direction of fluid flow, the current methodology may increase the internal conductive resistance of the heat exchanger fin at step 404 in order reduce the conductive heat transfer in an undesirable direction. This may be generally achieved by placing a plurality of notches perpendicular to the direction of fluid flow.

At step 406, the current methodology may obstruct the conductive heat transfer within the heat exchanger fin by alternating the placement of the plurality of notches between a top surface and a bottom surface of the heat exchanger fin. This alternative placement may increase the distance of travel of the internal thermal energy within a heat exchanger fin, hence obstructing conductive heat transfer within the heat exchanger fin. At step 408, the conductive heat transfer within the heat exchanger fin may be minimized by placing the plurality of notches equal distance from each other. Finally, at step 410, the notch pitch of 0.250 may be used to further minimize the conductive heat transfer within the heat exchanger fin.

It should be understood, of course, that the foregoing relates to exemplary embodiments of the invention and that modifications may be made without departing from the spirit and scope of the invention as set forth in the following claims.

We claim:

1. A cross flow heat exchanger increasing heat transfer performance comprising:

a plurality of hot plate fins within said cross flow heat exchanger; wherein said plurality of hot plate fins further comprises:

a hot fluid inlet positioned at a first terminal end of said plurality hot plate fins;

a hot fluid outlet positioned at a second terminal end of said plurality of hot plate fins opposite to said first terminal end; and a plurality of hot notches configured between 10° to 45°, inclusive, to a direction of hot fluid flow from said hot fluid inlet to said hot fluid outlet;

wherein said plurality of hot notches reduce a heat transfer along said direction of hot fluid flow;

a plurality of cold plate fins vertically interposed between said plurality of hot plate fins, wherein said plurality of cold plate fins further comprises:

a cold fluid inlet positioned at a first terminal end of said plurality of cold plate fins;

a cold fluid outlet positioned at a second terminal end of said plurality of cold plate fins opposite to said first terminal end; and a plurality of cold notches configured between 10° to 45°, inclusive, to a direction of cold fluid flow from said cold fluid inlet to said cold fluid outlet;

wherein said plurality of cold notches reduce a heat transfer along said direction of cold fluid flow;

wherein said direction of cold fluid flow is perpendicular to said direction of hot fluid flow;

wherein said plurality of hot notches are alternately placed along a top surface of said plurality of hot fins and a bottom surface of said plurality of hot fins along said direction of hot fluid flow;

wherein said plurality of cold notches are alternately placed along a top surface of said plurality of cold fins and a bottom surface of said plurality of cold fins along said direction of cold fluid flow;

wherein said plurality of hot notches are positioned equal distance from one another along said direction of hot fluid flow; and wherein said plurality of cold notches are positioned equal distance from one another along said direction of cold fluid flow.

2. The cross flow heat exchanger of claim 1, wherein said plurality of hot plate fins further comprises of a plurality of microchannels parallel to said direction of hot fluid flow.

3. The cross flow heat exchanger of claim 2, wherein said plurality of cold plate fins further comprises of a plurality of microchannels parallel to said direction of cold fluid flow.

4. The cross flow heat exchanger of claim 3, wherein said plurality of hot notches are rectangular in shape.

* * * * *